US009853364B2

(12) United States Patent
Zhai et al.

(10) Patent No.: US 9,853,364 B2
(45) Date of Patent: Dec. 26, 2017

(54) MULTIPLE-ANTENNA SYSTEM AND MOBILE TERMINAL

(71) Applicant: Huawei Technologies Co., Ltd., Shenzhen (CN)

(72) Inventors: Huiqing Zhai, Xi'an (CN); Zhihui Ma, Xi'an (CN); Zhenhua Li, Xi'an (CN); Changhong Liang, Xi'an (CN); Rongdao Yu, Shenzhen (CN); Sheng Liu, Shenzhen (CN)

(73) Assignee: Huawei Technologies Co., Ltd, Shenzhen (CN)

( * ) Notice: Subject to any disclaimer, the term of this patent is extended or adjusted under 35 U.S.C. 154(b) by 113 days.

(21) Appl. No.: 14/979,368

(22) Filed: Dec. 22, 2015

(65) Prior Publication Data

US 2016/0141767 A1 May 19, 2016

Related U.S. Application Data

(63) Continuation of application No. PCT/CN2014/073023, filed on Mar. 7, 2014.

(30) Foreign Application Priority Data

Jun. 28, 2013 (CN) ..... 2013 1 0270549

(51) Int. Cl.
*H01Q 21/00* (2006.01)
*H01Q 21/30* (2006.01)
(Continued)

(52) U.S. Cl.
CPC ..... *H01Q 21/30* (2013.01); *H01Q 1/243* (2013.01); *H01Q 1/38* (2013.01); *H01Q 1/521* (2013.01);
(Continued)

(58) Field of Classification Search
USPC ..... 343/893
See application file for complete search history.

(56) References Cited

U.S. PATENT DOCUMENTS 5,977,924 A * 11/1999 Takei ..... H01Q 21/068 343/700 MS
6,133,880 A * 10/2000 Grangeat ..... H01P 5/08 343/700 MS
(Continued)

FOREIGN PATENT DOCUMENTS

CN 1885544 A 12/2006
CN 201655979 U 11/2010
(Continued)

OTHER PUBLICATIONS

Li, G. et al., Isolation-Improved Dual-Band MIMO Antenna Array for LTE/WiMAX Mobile Terminals, IEEE Antennas and Wireless Propagation Letters, vol. 13, 2014 4 pages.

*Primary Examiner* — Jessica Han
*Assistant Examiner* — Hai Tran
(74) *Attorney, Agent, or Firm* — Slater Matsil, LLP

(57) ABSTRACT

A multiple-antenna system includes a planar inverted-F antenna PIFA of a first type, which includes a metallic ground plane, a dielectric plate, a radiation patch, a probe-type feeding unit, and a metallic shorting pin. The system also includes a PIFA of a second type perpendicular to the PIFA of the first type and including a metallic ground plane, a radiation patch, a feeding unit, and a metallic shorted patch. The radiation patch is connected to the metallic ground plane by using the feeding unit and the metallic shorted patch. Isolation stub is located on an edge of a side, close to the PIFA of the second type, of the upper surface of the dielectric plate of the PIFA of the first type.

18 Claims, 12 Drawing Sheets

(51) Int. Cl.

| | |
|---|---|
| ***H01Q 1/24*** | (2006.01) |
| ***H01Q 9/04*** | (2006.01) |
| ***H01Q 1/52*** | (2006.01) |
| ***H01Q 21/28*** | (2006.01) |
| ***H01Q 1/38*** | (2006.01) |
| *H01Q 5/364* | (2015.01) |
| *H01Q 5/371* | (2015.01) |

(52) U.S. Cl.
CPC ..... *H01Q 9/04* (2013.01); *H01Q 9/0421* (2013.01); *H01Q 21/28* (2013.01); *H01Q 5/364* (2015.01); *H01Q 5/371* (2015.01)

(56) References Cited

U.S. PATENT DOCUMENTS

| | | | | |
|---|---|---|---|---|
| 6,426,723 | B1 | 7/2002 | Smith et al. | |
| 7,636,065 | B2 * | 12/2009 | Ohishi | H01Q 3/2682 343/702 |
| 7,924,225 | B2 * | 4/2011 | Mak | G01S 3/18 342/432 |
| 8,164,525 | B2 * | 4/2012 | Park | H01Q 1/2266 343/700 MS |
| 8,654,032 | B2 * | 2/2014 | Yoon | H01Q 1/521 343/702 |
| 2003/0193437 | A1 * | 10/2003 | Kangasvieri | H01Q 1/243 343/702 |
| 2003/0201943 | A1 | 10/2003 | Kadambi et al. | |
| 2003/0231134 | A1 | 12/2003 | Yarasi et al. | |
| 2004/0137950 | A1 | 7/2004 | Bolin et al. | |
| 2006/0038736 | A1 | 2/2006 | Hui et al. | |
| 2006/0214798 | A1 | 9/2006 | Wang | |
| 2008/0316098 | A1 | 12/2008 | Mitsui | |
| 2009/0058736 | A1 | 3/2009 | Chiang | |
| 2009/0102742 | A1 | 4/2009 | Park et al. | |
| 2009/0315759 | A1 | 12/2009 | Mak et al. | |
| 2011/0175792 | A1 | 7/2011 | Yoon et al. | |
| 2011/0215971 | A1 | 9/2011 | Rao | |
| 2011/0241953 | A1 | 10/2011 | Su | |
| 2011/0298669 | A1 | 12/2011 | Rao et al. | |
| 2012/0319919 | A1 * | 12/2012 | Kirovski | H01Q 1/243 343/853 |
| 2014/0320363 | A1 | 10/2014 | Ng et al. | |

FOREIGN PATENT DOCUMENTS

| | | | |
|---|---|---|---|
| CN | 102394368 | A | 3/2012 |
| CN | 102751573 | A | 10/2012 |
| CN | 102782936 | A | 11/2012 |
| CN | 102934510 | A | 2/2013 |
| EP | 1387433 | A1 | 2/2004 |
| JP | 2003332818 | A | 11/2003 |
| JP | 2004104333 | A | 4/2004 |
| JP | 2005072902 | A | 3/2005 |
| JP | 2009100444 | A | 5/2009 |
| TW | 201248995 | A | 12/2012 |
| WO | 02089249 | A1 | 11/2002 |
| WO | 2013012403 | A1 | 1/2013 |

* cited by examiner

MULTIPLE-ANTENNA SYSTEM AND MOBILE TERMINAL

This application is a continuation of International Patent Application No. PCT/CN2014/073023, filed on Mar. 7, 2014, which claims priority to Chinese Patent Application No. 201310270549.8, filed on Jun. 28, 2013, both of which are hereby incorporated by reference in their entireties.

TECHNICAL FIELD

The present invention relates to the field of wireless communications technologies, and in particular, to a multiple-antenna system and a mobile terminal.

BACKGROUND

With rapid development of mobile communications technologies, application of small-sized mobile terminals, for example, mobile phones, is becoming increasingly popular. An air interface used by a small-sized mobile terminal to communicate with a base station and to receive and transmit a radio frequency signal is an antenna, and power of the small-sized mobile terminal is transmitted to the base station in a form of an electromagnetic wave by using the antenna. Therefore, the antenna plays a key role in the mobile communications technologies.

A planar inverted-F antenna (PIFA) is a common antenna used on a mobile phone and is increasingly widely applied to a mobile terminal because of advantages of the PIFA, such as a small size, a light weight, a low profile, a simple structure, and ease of integration.

A PIFA includes four parts: a metallic ground plane, a radiation patch, a short-circuit structure, and a feeding network, where the radiation patch may be in any shape. The PIFA has a resonant length that is only one fourth of an operating wavelength of an antenna, is small in size, and is in a plane structure, and therefore, can be applied to a small-sized portable mobile terminal such as a mobile phone.

However, as functions of a mobile terminal increase continuously, a multi-input multi-output (MIMO) technology emerges, which requires the mobile terminal to use multiple antennas to implement reception and transmission of data and information. However, multiple PIFAs are limited to such a cramped and complex electromagnetic environment as a mobile terminal, and therefore, a requirement for high isolation between multiple frequency bands cannot be met.

SUMMARY

In view of this, embodiments of the present invention provide a multiple-antenna system and a mobile terminal, so as to meet a requirement for high isolation between multiple frequency bands.

According to a first aspect, an embodiment of the present invention provides a multiple-antenna system. A planar inverted-F antenna PIFA of a first type includes a metallic ground plane, a dielectric plate, a radiation patch, a probe-type feeding unit, and a metallic shorting pin. The radiation patch is located on an upper surface of the dielectric plate and is connected to the metallic ground plane by using the probe-type feeding unit and the metallic shorting pin. A PIFA of a second type is perpendicular to the PIFA of the first type and includes a metallic ground plane, a radiation patch, a feeding unit, and a metallic shorted patch. The radiation patch is connected to the metallic ground plane by using the feeding unit and metallic shorted patch. In isolation stub is located on an edge of a side, close to the PIFA of the second type, of an upper surface of the dielectric plate of the PIFA of the first type.

With reference to the first aspect, in a first possible implementation manner of the first aspect, a distance from the PIFA of the first type to the PIFA of the second type is greater than or equal to a preset threshold.

With reference to the first possible implementation manner of the first aspect, in a second possible implementation manner of the first aspect, the preset threshold is 7 mm.

With reference to the first aspect or the first or the second possible implementation manner of the first aspect, in a third possible implementation manner of the first aspect, a U-shaped groove is etched on the radiation patch of the PIFA of the first type.

With reference to the first aspect or any one of the first to the third possible implementation manners of the first aspect, in a fourth possible implementation manner of the first aspect, an L-shaped slot is etched on the radiation patch of the PIFA of the second type.

With reference to the first aspect or any one of the first to the fourth possible implementation manners of the first aspect, in a fifth possible implementation manner of the first aspect, the feeding unit of the PIFA of the second type is an L-shaped coaxial feeding unit.

With reference to the first aspect or any one of the first to the fifth possible implementation manners of the first aspect, in a sixth possible implementation manner of the first aspect, the PIFA of the second type further includes an L-shaped folded metallic ground plane, where the L-shaped folded metallic ground plane is disposed on an edge of the metallic ground plane of the PIFA of the second type.

With reference to the first aspect or any one of the first to the sixth possible implementation manners of the first aspect, in a seventh possible implementation manner of the first aspect, there are four PIFAs of the first type and four PIFAs of the second type, where the four PIFAs of the first type are located at four corners of a quadrangle, two of the PIFAs of the second type are located outside a first side of the quadrangle, and the other two PIFAs of the second type are located outside a second side of the quadrangle, the first side is opposite to the second side, and a distance from any one of the PIFAs of the first type to a nearest PIFA of the second type is greater than or equal to 7 mm.

With reference to the seventh possible implementation manner of the first aspect, in an eighth possible implementation manner of the first aspect, a slot is etched on the radiation patch of the PIFA of the second type, and the radiation patch is in a shape obtained by cutting off three corners from a rectangular.

With reference to the first aspect or any one of the first to the eighth possible implementation manners of the first aspect, in a ninth possible implementation manner of the first aspect, a dielectric constant of the dielectric plate is between 1 and 10.

According to a second aspect, an embodiment of the present invention provides a mobile terminal, including a mobile terminal body and any one of the foregoing multiple-antenna systems, where the multiple-antenna system is connected to the mobile terminal body and is used to receive and transmit a signal for the mobile terminal body.

According to the multiple-antenna system and the mobile terminal that are provided in the foregoing embodiments, two different operating frequency bands may be provided by using two PIFAs. The two antennas are perpendicular to each other, and a distance between the two antennas is greater than or equal to a preset threshold, so that isolation between the antennas and isolation between the operating frequency bands meet an operating requirement of the multiple-antenna system. In addition, on a premise of meeting high isolation between multiple frequency bands, the multiple-antenna system occupies less space.

BRIEF DESCRIPTION OF THE DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and persons of ordinary skill in the art may still derive other drawings from these accompanying drawings without creative efforts.

DETAILED DESCRIPTION OF ILLUSTRATIVE EMBODIMENTS

To make the objectives, technical solutions, and advantages of the present invention clearer, the following further describes the present invention in detail with reference to the accompanying drawings. Apparently, the described embodiments are merely some but not all of the embodiments of the present invention. All other embodiments obtained by persons of ordinary skill in the art based on the embodiments of the present invention without creative efforts shall fall within the protection scope of the present invention.

Figure 1:
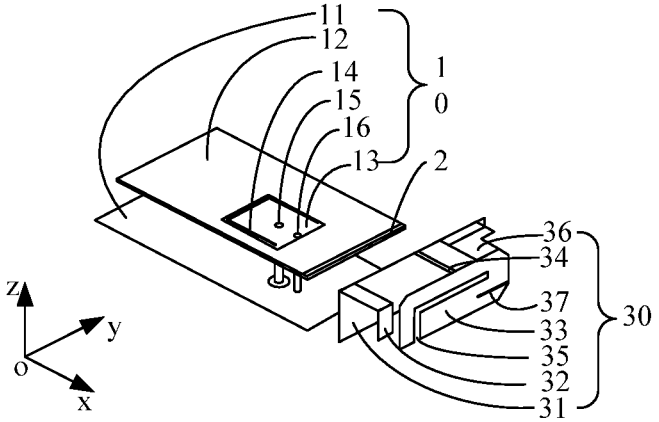
FIG. 1 is a three-dimensional schematic diagram of a multiple-antenna system according to an embodiment of the present invention.

FIG. 1 is a three-dimensional schematic diagram of a multiple-antenna system according to an embodiment of the present invention. In this embodiment, the multiple-antenna system includes a PIFA 10 of a first type, a PIFA 30 of a second type, and an isolation stub 2.

The PIFA 10 of the first type is located on an azimuth plane (for example, an xoy coordinate plane in FIG. 1) and includes a metallic ground plane 11, a dielectric plate 12, a radiation patch 13, a probe-type feeding unit 15, and a metallic shorting pin 16.

The radiation patch 13 is disposed on an upper surface of the dielectric plate 12 and is connected to the metallic ground plane 11 by using the probe-type feeding unit 15 and the metallic shorting pin 16.

The isolation stub 2 is a patch and is disposed on an edge, close to the PIFA 30 of the second type, of the upper surface of the dielectric plate 12, to improve isolation between the PIFA 10 of the first type and the PIFA 30 of the second type.

The PIFA 30 of the second type is located on a side view plane (for example, an xoz coordinate plane in FIG. 1) perpendicular to the azimuth plane. That is, the PIFA 10 of the first type and the PIFA 30 of the second type are mutually orthogonal, thereby reducing coupling between the antennas and improving isolation between the antennas. The PIFA 30 of the second type includes a metallic ground plane 31, a radiation patch 33, a feeding unit 36, and a metallic shorted patch 34. The radiation patch 33 is connected to the metallic ground plane 31 by using the feeding unit 36 and the metallic shorted patch 34.

A distance from the PIFA 10 of the first type to the PIFA 30 of the second type is set to be greater than or equal to a preset threshold (for example, 7 mm), which can further improve the isolation between the antennas.

According to the multiple-antenna system provided in this embodiment, two different operating frequency bands may be provided by using two PIFAs. The two antennas are perpendicular to each other, a distance between the two antennas is greater than or equal to a preset threshold, and the two antennas are isolated by an isolation stub, so that isolation between the antennas and isolation between the operating frequency bands meet an operating requirement of the multiple-antenna system. In addition, the PIFAs are small in size, so that the multiple-antenna system occupies less space, which facilitates further increase in a quantity of antennas and makes further reduction in a volume of a mobile terminal possible.

Further, a U-shaped groove 14 may be disposed on the radiation patch 13 of the PIFA 10 of the first type, so that the PIFA 10 of the first type can generate two different current paths, thereby enabling the PIFA 10 of the first type to implement two operating frequency bands.

Further, the feeding unit 36 may be an L-shaped coaxial feeding unit. An L-shaped slot 35 may be disposed on the radiation patch 33 of the PIFA 30 of the second type, so that the PIFA 30 of the second type can generate two different current paths, thereby enabling the PIFA 30 of the second type to implement two operating frequency bands.

Further, if there are multiple PIFAs of the second type on the side view plane, a straight-line-shaped slot 37 may be disposed on the radiation patch 33 of the PIFA 30 of the second type and three corners of the radiation patch 33 are cut off, which changes a flow direction of a current on the radiation patch of the PIFA 30 of the second type that operates in a high frequency band, thereby improving isolation, on the side view plane, between the PIFAs of the second type in the high frequency band.

Further, the PIFA 30 of the second type may further include an L-shaped folded metallic ground plane 32, which can further improve isolation between the multiple PIFAs 30 of the second type.

Figure 2:
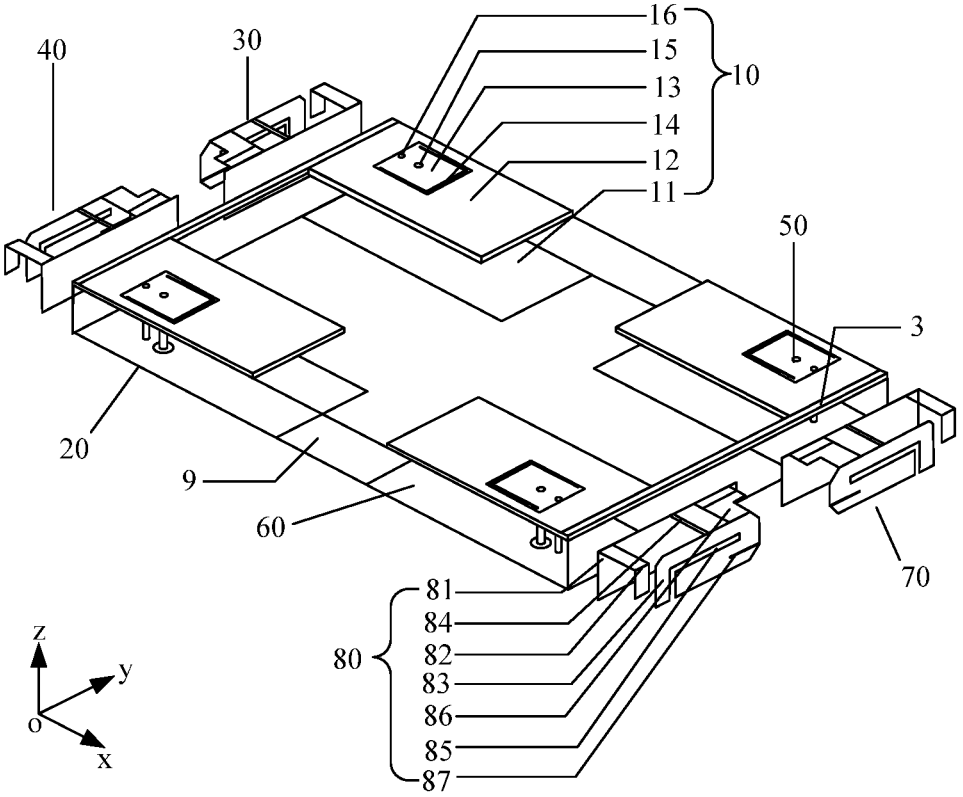
FIG. 2 is a three-dimensional schematic diagram of a multiple-antenna system according to another embodiment of the present invention.
Figure 3:
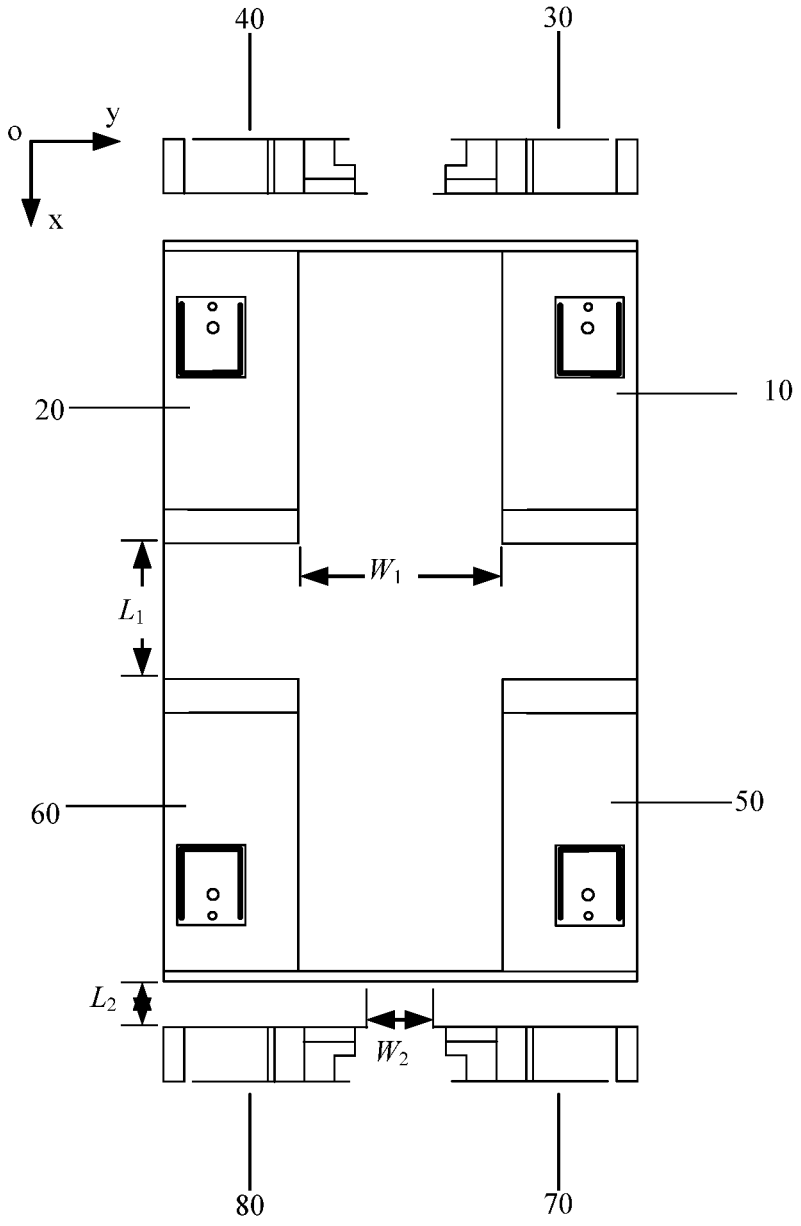
FIG. 3 is a schematic diagram of the multiple-antenna system shown in FIG. 2 on an azimuth plane.

FIG. 2 is a three-dimensional schematic diagram of a multiple-antenna system according to another embodiment of the present invention. In this embodiment, the multiple-antenna system includes four PIFAs of a first type: a PIFA 10 of the first type, a PIFA 20 of the first type, a PIFA 50 of the first type, and a PIFA 60 of the first type; and four PIFAs of a second type: a PIFA 30 of the second type, a PIFA 40 of the second type, a PIFA 70 of the second type, and a PIFA 80 of the second type.

The PIFA 10 of the first type, the PIFA 20 of the first type, the PIFA 50 of the first type, and the PIFA 60 of the first type are located on an azimuth plane (for example, a plane where an x-axis and a y-axis are located in FIG. 1). A distance, in a direction of the y-axis, between the PIFA 10 of the first type and the PIFA 20 of the first type is: $W_1$=30 mm. A distance, in a direction of the x-axis, between the PIFA 20 of the first type and the PIFA 60 of the first type is: $L_1$=20 mm. The PIFA 10 of the first type and the PIFA 20 of the first type are connected to the PIFA 50 of the first type and the PIFA 60 of the first type by using a dielectric plate whose dielectric constant $\in_r$=4.4. It should be noted that, the distance, in the direction of the y-axis, between the PIFA 10 of the first type and the PIFA 20 of the first type may be less than 30 mm or may be greater than 30 mm, provided that the distance can meet a requirement for isolation between the PIFA 10 of the first type and the PIFA 20 of the first type. The distance, in the direction of the x-axis, between the PIFA 20 of the first type and the PIFA 60 of the first type may be less than 20 mm or may be greater than 20 mm, provided that the distance can meet a requirement for isolation between the PIFA 60 of the first type and the PIFA 20 of the first type. The foregoing dielectric constant may be set to another value.

The PIFA 30 of the second type, the PIFA 40 of the second type, the PIFA 70 of the second type, and the PIFA 80 of the second type are located on a side view plane. A distance, in a direction of the y-axis, between the PIFA 70 of the second type and the PIFA 80 of the second type is : $W_2$=10 mm.

The side view plane is perpendicular to the azimuth plane. Distances, in a direction of the x-axis, between the PIFA 60 of the first type and the PIFA 80 of the second type, between the PIFA 50 of the first type and the PIFA 70 of the second type, between the PIFA 10 of the first type and the PIFA 30 of the second type, and between the PIFA 20 of the first type and the PIFA 40 of the second type are all: $L_1 \geq 7$ mm. The PIFA 30 of the second type, the PIFA 10 of the first type, the PIFA 50 of the first type, and the PIFA 70 of the second type are respectively symmetrical to the PIFA 40 of the second type, the PIFA 20 of the first type, the PIFA 60 of the first type, and the PIFA 80 of the second type with respect to an xoz coordinate plane. The PIFA 30 of the second type, the PIFA 40 of the second type, the PIFA 10 of the first type, and the PIFA 20 of the first type are respectively symmetrical to the PIFA 70 of the second type, the PIFA 80 of the second type, the PIFA 50 of the first type, and the PIFA 60 of the first type with respect to a yoz coordinate plane. That is, the four antennas, namely, the PIFA 10 of the first type, the PIFA 20 of the first type, the PIFA 50 of the first type, and the PIFA 60 of the first type, on the azimuth plane have an orthogonal polarization relationship with the four antennas, namely, the PIFA 30 of the second type, the PIFA 40 of the second type, the PIFA 70 of the second type, and the PIFA 80 of the second type, on the side view plane.

The PIFA 10 of the first type, the PIFA 20 of the first type, the PIFA 50 of the first type, and the PIFA 60 of the first type are in a same structure and all include a metallic ground plane, a dielectric plate, a radiation patch, a probe-type feeding unit, and a metallic shorting pin.

The following uses the PIFA 10 of the first type to describe the structure of the PIFAs of the first type.

The PIFA 10 of the first type includes a metallic ground plane 11, a dielectric plate 12, a radiation patch 13, a probe-type feeding unit 15, and a metallic shorting pin 16.

Figure 4A:
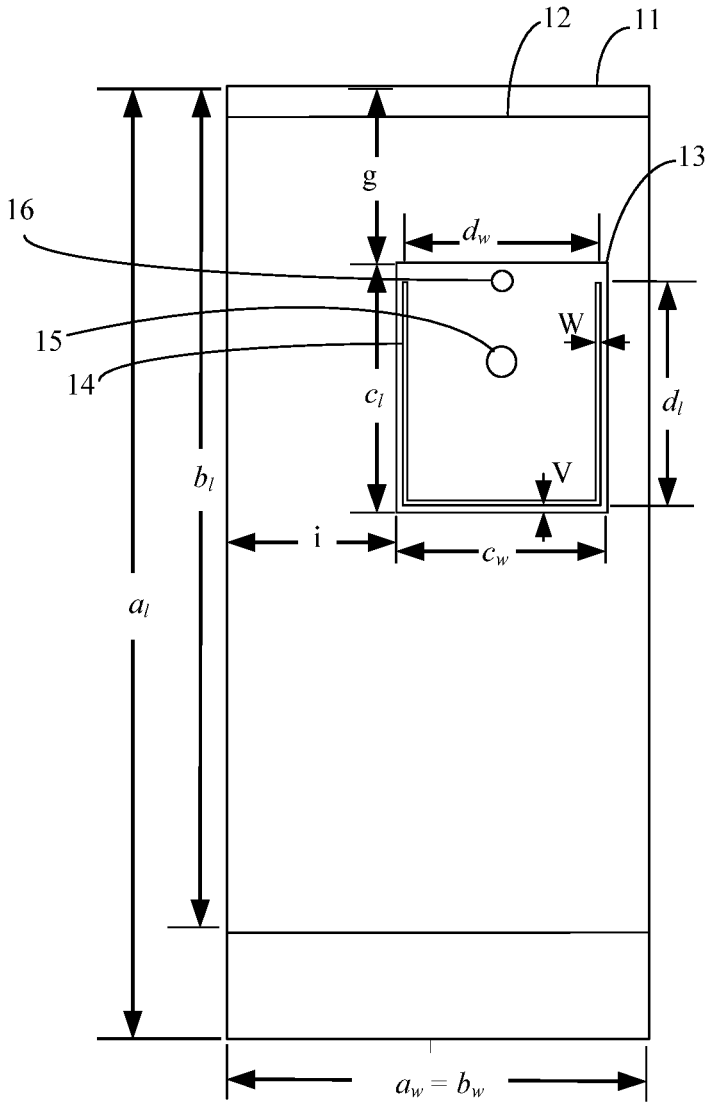
FIG. 4*a* is a front view of a PIFA 10 of a first type in FIG. 2.
Figure 4B:
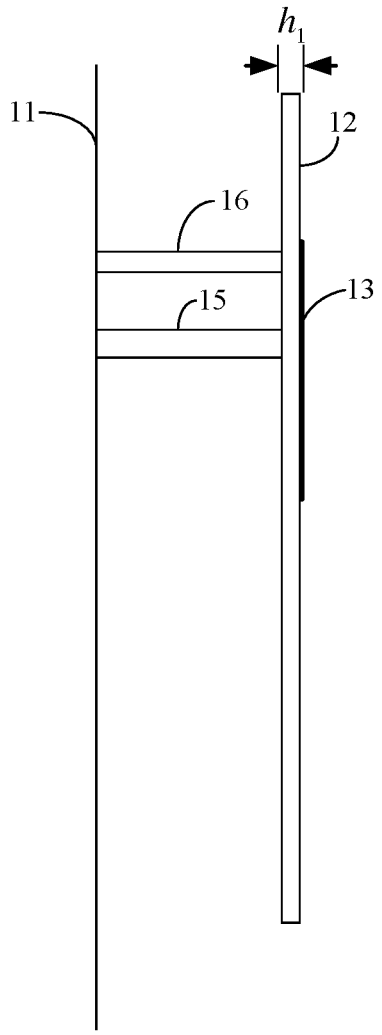
FIG. 4*b* is a side view of the PIFA 10 of the first type.

As shown in FIG. 4*a* and FIG. 4*b*, a length of the metallic ground plane 11 is: $a_1$=45 mm, and a width of the metallic ground plane 11 is: $a_w$=20 mm. A length of the dielectric plate 12 is: $b_1$=40 mm, a width of the dielectric plate 12 is: $b_w$=20 mm, and a height of the dielectric plate 12 is: $h_1$=0.9 mm. A length of the radiation patch 13 is: $c_1$=11.9 mm, a width of the radiation patch 13 is: $c_w$=10 mm, a horizontal distance from the radiation patch 13 to a narrow side of the metallic ground plane 11 is: g=8.3 mm, and a horizontal distance from the radiation patch 13 to a wide side of the metallic ground plane 11 is: i=8 mm.

The radiation patch 13 is printed on an upper surface of the dielectric plate 12 and is connected to the metallic ground plane 11 by using the metallic shorting pin 16. A foam support 9 is used as a support between the dielectric plate 12 and the metallic ground plane 11.

A U-shaped groove 14 is etched on the radiation patch 13. For example, a length of the U-shaped groove 14 is: $d_1$=10.55 mm, a width of the U-shaped groove 14 is: $d_w$=9.4 mm, a line width of the U-shaped groove 14 is: W=0.3 mm, a distance from a base side of the U-shaped groove 14 to a base side of the radiation patch 13 is: v=0.4 mm, and a distance from a right side of the U-shaped groove 14 to a right side of the radiation patch 13 and a distance from a left side of the U-shaped groove 14 to a left side of the radiation patch 13 are both 0.3 mm. After the U-shaped groove 14 is etched, the PIFA 10 of the first type is enabled to operate in two frequency bands: 2.558 GHz-2.801 GHz and 3.387 GHz-3.666 GHz. The PIFA 10 of the first type may be enabled to operate in another two frequency bands by adjusting values of $c_1$ and $c_w$ and values of $d_1$ and $d_w$, so as to meet a requirement for different operating frequency bands of the PIFA of the first type.

A radius of the probe-type feeding unit 15 is 0.7 mm, a height of the probe-type feeding unit 15 is 9.55 mm, and a distance from a center of the probe-type feeding unit 15 to the base side of the radiation patch 13 is 7.2 mm.

A radius of the metallic shorting pin 16 is 0.5 mm, a height of the metallic shorting pin 16 is 9.55 mm, and a distance from a center of the metallic shorting pin 16 to the center of the probe-type feeding unit 15 is 3.8 mm.

An operating bandwidth and an impedance matching feature of the PIFA 10 of the first type can be adjusted by adjusting the radiuses, locations, and the heights of the probe-type feeding unit 15 and the metallic shorting pin 16.

An isolation stub 3 is printed on the upper surface of the dielectric plate 12. The isolation stub 3 is a rectangular metallic patch with a length of 70 mm and a width of 1.5 mm and is located between the PIFA of the first type and the PIFA of the second type. It can be seen from FIG. 2 that, the dielectric plate of the PIFA 10 of the first type and the dielectric plate of the PIFA 20 of the first type are connected at a side close to the PIFA 30 of the second type and the PIFA 40 of the second type, where a width of a connection part is the same as the width of the isolation stub 3.

The isolation stub 3 resonates at a range around 2.7 GHz, which can increase isolation between the antennas by approximately 2.5 dB when the antennas operate in a frequency band of 2.675 GHz-2.762 GHz.

The PIFA 30 of the second type, the PIFA 40 of the second type, the PIFA 70 of the second type, and the PIFA 80 of the second type are in a same structure and all include a metallic ground plane, an L-shaped folded metallic ground plane, an L-shaped coaxial feeding unit, a metallic shorted patch, and a radiation patch.

The following uses the PIFA 80 of the second type to describe the structure of the PIFAs of the second type.

The PIFA 80 of the second type includes a metallic ground plane 81, an L-shaped folded metallic ground plane 82, an L-shaped coaxial feeding unit 86, a metallic shorted patch 84, and a radiation patch 83.

Figure 5A:
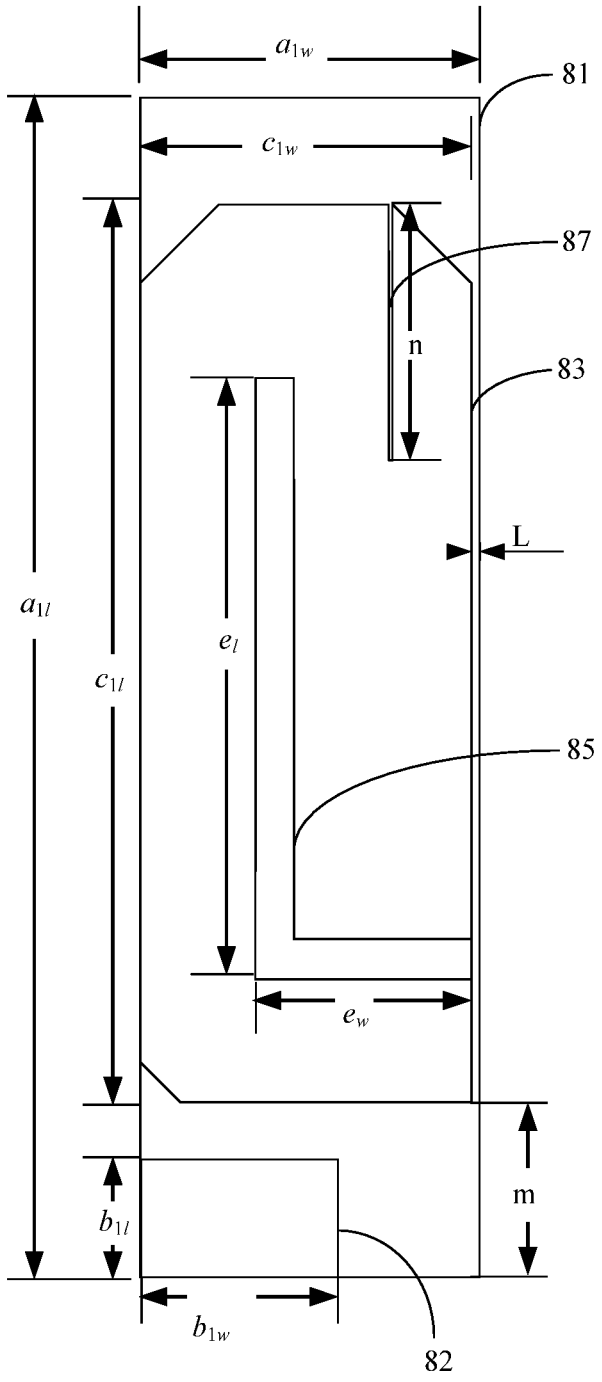
FIG. 5*a* is a front view of a PIFA 80 of a second type in FIG. 2.
Figure 5B:
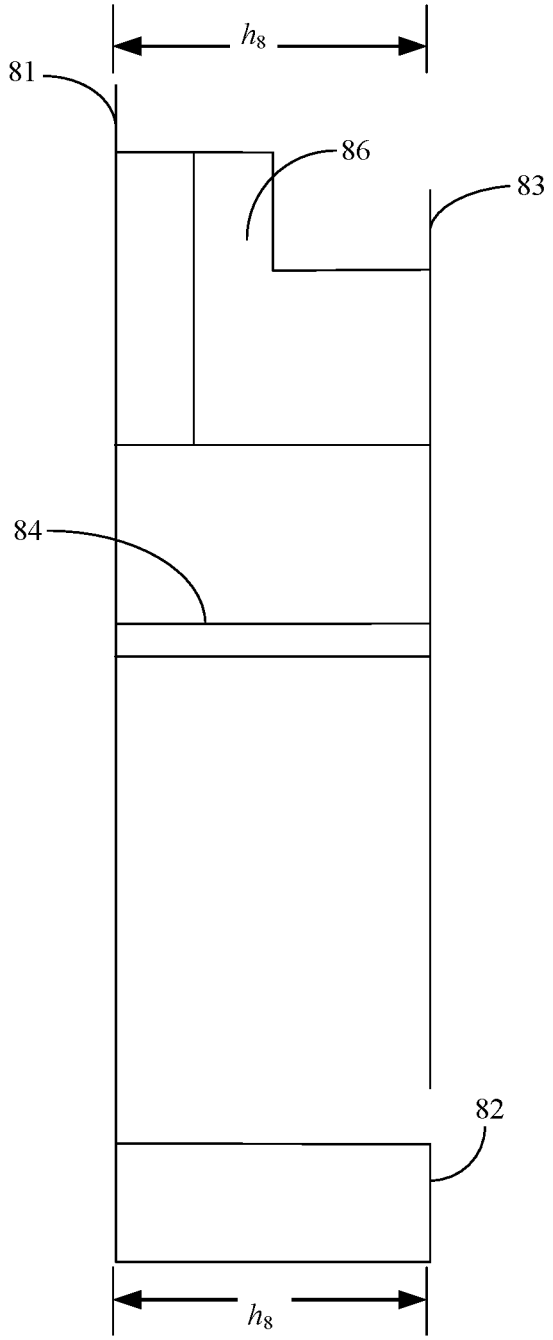
FIG. 5*b* is a side view of the PIFA 80 of the second type.

As shown in FIG. 5*a*, a length of the metallic ground plane 81 is: $a_{1l}$=30 mm, and a width of the metallic ground plane 81 is: $a_{1w}$=8.6 mm. The L-shaped folded metallic ground plane 82 is disposed on an edge of the metallic ground plane 81. A height of the L-shaped folded metallic ground plane 82 is $h_8$=8 mm, and a length and a width of the L-shaped folded metallic ground plane 82 are respectively: $b^{1l}$=3 mm and $b_{1w}$=5 mm. The L-shaped folded metallic ground plane 82 can implement miniaturization of the PIFA 80 of the second type, thereby reducing space occupied by antennas.

The radiation patch 83 is connected to the metallic ground plane 81 by using the metallic shorted patch 84.

The radiation patch 83 is a metallic patch that is etched with an L-shaped slot 85 and disposed with a straight-line-shaped slot 87 and that is in a shape obtained by cutting off three corners from a rectangular metallic patch.

A length of the radiation patch 83 is: $c_{1l}$=22.8 mm, and a width of the radiation patch 83 is: $c_{1w}$=8.4 mm, and a horizontal distance from the radiation patch 83 to a wide side of the metallic ground plane 81 is: 1=0.2 mm, and a horizontal distance from the radiation patch 83 to a narrow side of the metallic ground plane 81 is: m=4.5 mm.

A length of the L-shaped slot 85 is: $e_l$=15.3 mm, and a width of the L-shaped slot 85 is: $e_w$=5.5 mm. A slot width of the L-shaped slot 85 is 1 mm. A distance from a base side of the L-shaped slot 85 to a base side of the radiation patch 83 is 3.1 mm. A distance from a left side of the L-shaped slot 85 to a left side of the radiation patch 83 is 2.9 mm. After the L-shaped slot 85 is etched, the PIFA 80 of the second type is enabled to operate in two frequency bands: 2.631 GHz-2.722 GHz and 3.440 GHz-3.529 GHz. Two operating frequency bands required by the PIFA 80 of the second type can be obtained by adjusting values of $c_{1l}$ and $c_{1w}$ and values of $e_l$ and $e_w$.

Among the three corners that are cut off, two corners have a side length of 2 mm and the other corner has a side length of 1 mm.

A width of the straight-line-shaped slot 87 is 0.1 mm, and a length of the straight-line-shaped slot 87 is 6.5 mm. Cutting off three corners from a rectangular metallic patch and disposing a slot on a remaining metallic patch can improve isolation between the PIFAs of the second type when the PIFAs of the second type operate in a high frequency band.

A width of the L-shaped coaxial feeding unit 86 is 7.5 mm, and a height of the L-shaped coaxial feeding unit 86 is 6 mm. The L-shaped coaxial feeding unit 86 is in a shape of a rectangle obtained by cutting off a rectangle on a corner, where a length of the rectangle that is cut off is 3 mm, and a width of the rectangle that is cut off 4 mm.

Because the PIFA 30 of the second type, the PIFA 40 of the second type, the PIFA 70 of the second type, and the PIFA 80 of the second type are in the same structure, cutting off the rectangle can effectively improve isolation, in a frequency band of 3.466 GHz-3.546 GHz, between the PIFA 70 of the second type and PIFA 80 of the second type and between the PIFA 30 of the second type and PIFA 40 of the second type.

A distance from the metallic shorted patch 84 to the L-shaped coaxial feeding unit 86 is 4.5 mm. A width of the metallic shorted patch 84 is 0.9 mm, and a height of the metallic shorted patch 84 is 8 mm.

An operating frequency band and an impedance matching feature of the antenna can be adjusted by setting locations, the widths, and the heights of the L-shaped coaxial feeding unit 86 and the metallic shorted patch 84.

The multiple-antenna system provided in this embodiment includes four PIFAs of the first type and four PIFAs of the second type. A distance from an antenna on an azimuth plane to a nearest antenna on a side view plane is equal to 7 mm. Each of the eight antennas has its own independent metallic ground plane, which improves isolation between the antennas to some extent when the antennas operate in two frequency bands. In addition, an orthogonal polarization relationship between four antennas on the azimuth plane and four antennas on the side view plane further improves the isolation between the antennas in two frequency bands. Because L-shaped slots are etched on radiation patches of the four antennas on the side view plane, the antennas are enabled to operate in two frequency bands: 2.631 GHz-2.722 GHz and 3.440 GHz-3.529 GHz. Because the four antennas on the side view plane use L-shaped coaxial feeding units, flow directions of currents on the feeding units of the antennas in a high frequency band present included angles of 90 degrees, which greatly improves isolation between the antennas in a high frequency band. Because slots are etched on radiation patches of the four antennas on the side view plane and three right triangles are cut off from the radiation patch, flow directions of currents on the radiation patches in a high frequency band are changed, thereby improving isolation between the antennas in a high frequency band. Simple isolation stubs are used, so that the antennas generate resonance at the isolation stubs, which greatly improves isolation, in a low frequency band, between the four antennas on the azimuth plane and the four antennas on the side plane. Folded metallic ground planes are used, which further improves isolation between multiple antennas of the second type. Because PIFAs are used, the multiple-antenna system features a simple, small, and compact structure, easy fabrication, and low costs, and is easy integrated with a radio frequency front-end microwave circuit. In addition, a resonance operating point of an antenna can be adjusted by changing sizes and locations of a radiation patch, a U-shaped groove, an L-shaped slot, a coaxial feeding unit, a short-circuit unit, and an isolation stub, so as to meet different application requirements.

Simulation results of a parameter S of the multiple-antenna system shown in FIG. 2 are shown in FIG. 6*a* to FIG. 6*d* and FIG. 7*a* to FIG. 7*d*.

Figure 6A:
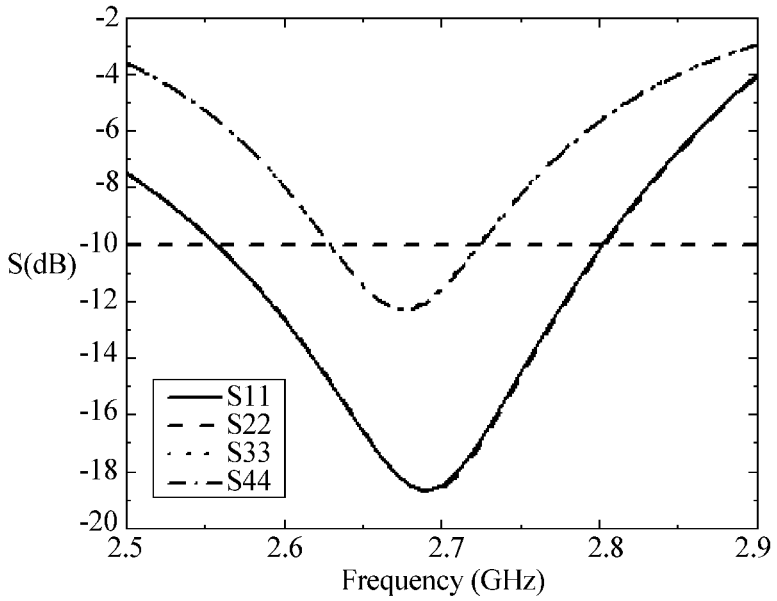
FIG. 6*a* to FIG. 6*d* are simulation diagrams of a parameter S of the multiple-antenna system shown in FIG. 2 in a frequency band of 2.631 GHz-2.722 GHz.

In FIG. 6*a*, S11 indicates an impedance matching feature of the PIFA 10 of the first type, S22 indicates an impedance matching feature of the PIFA 20 of the first type, S33 indicates an impedance matching feature of the PIFA 30 of the second type, and S44 indicates an impedance matching feature of the PIFA 40 of the second type. It can be seen that, an operating frequency range of the PIFA 10 of the first type and the PIFA 20 of the first type is 2.558 GHz-2.801 GHz, and an operating frequency range of the PIFA 30 of the second type and the PIFA 40 of the second type is 2.631 GHz-2.722 GHz.

Figure 6B:
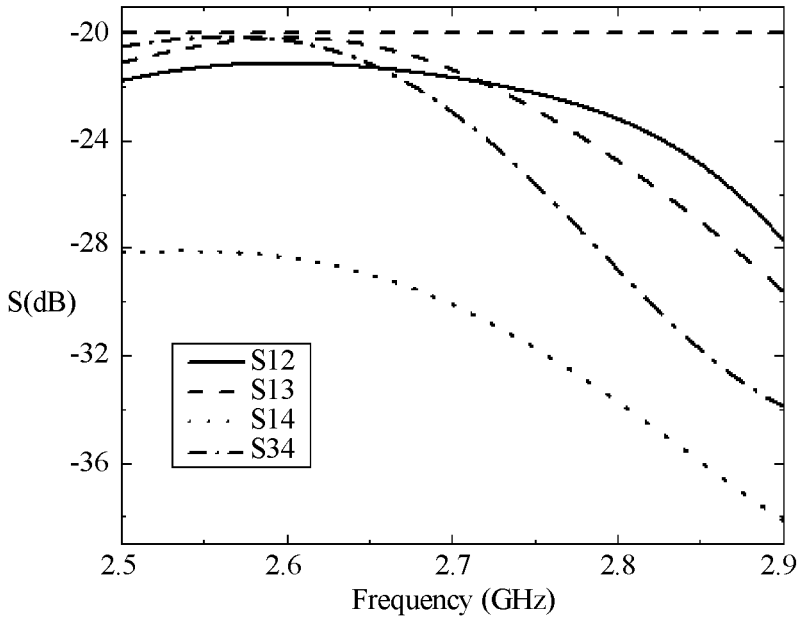

In FIG. 6*b*, S12 indicates isolation between the PIFA 10 of the first type and the PIFA 20 of the first type, S13 indicates isolation between the PIFA 10 of the first type and the PIFA 30 of the second type, S14 indicates isolation between the PIFA 10 of the first type and the PIFA 40 of the second type, and S34 indicates isolation between the PIFA 30 of the second type and the PIFA 40 of the second type. It can be seen that, S12, S13, S14, and S34 are all less than −20 dB.

Figure 6C:
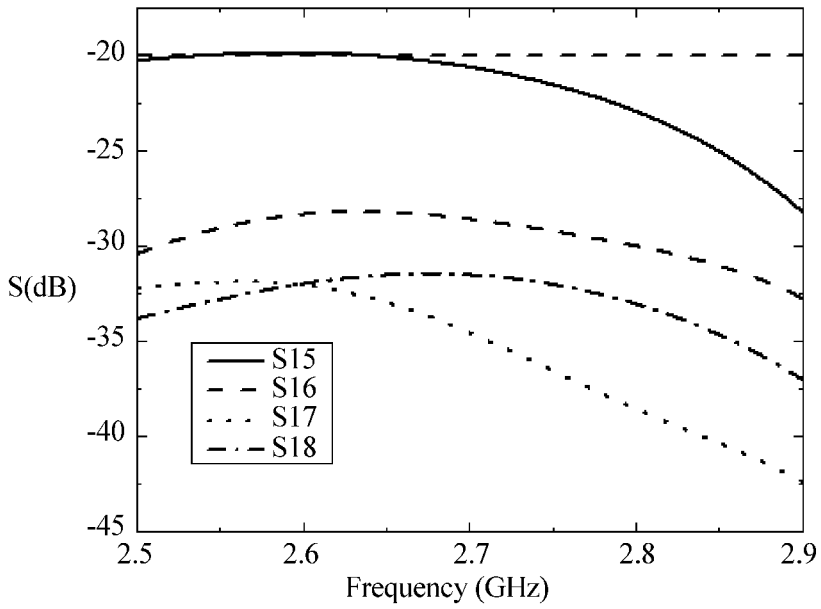

In FIG. 6*c*, S15 indicates isolation between the PIFA 10 of the first type and the PIFA 50 of the first type, S16 indicates isolation between the PIFA 10 of the first type and the PIFA 60 of the first type, S17 indicates isolation between the PIFA 10 of the first type and the PIFA 70 of the second type, and S18 indicates isolation between the PIFA 10 of the first type and the PIFA 80 of the second type. It can be seen that, S15, S16, S17, and S18 are all less than −20 dB.

Figure 6D:
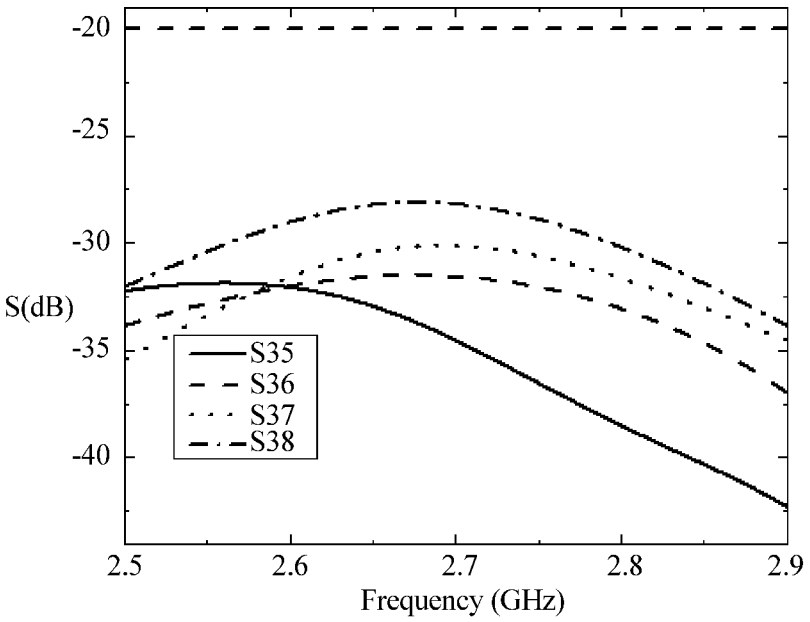

In FIG. 6*d*, S35 indicates isolation between the PIFA 30 of the second type and the PIFA 50 of the first type, S36 indicates isolation between the PIFA 30 of the second type and the PIFA 60 of the first type, S37 indicates isolation between the PIFA 30 of the second type and the PIFA 70 of the second type, and S38 indicates isolation between the PIFA 30 of the second type and the PIFA 80 of the second type. It can be seen that, S35, S36, S37, and S38 are all less than −25 dB.

Figure 7A:
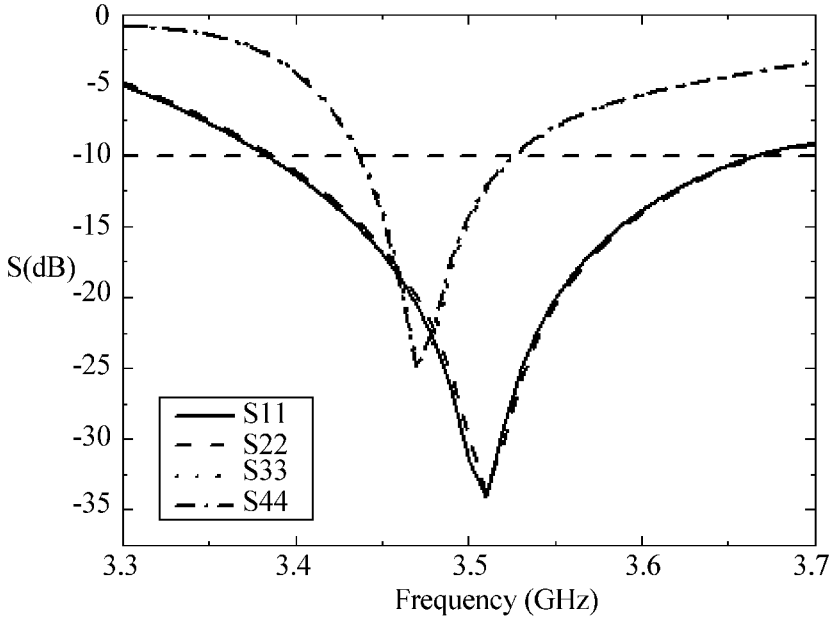
FIG. 7*a* to FIG. 7*d* are simulation diagrams of a parameter S of the multiple-antenna system shown in FIG. 2 in a frequency band of 3.440 GHz-3.529 GHz.

In FIG. 7*a*, it can be seen that, an operating frequency range of the PIFA 10 of the first type and the PIFA 20 of the first type is 3.387 GHz-3.666 GHz, and an operating frequency range of the PIFA 30 of the second type and the PIFA 40 of the second type is 3.440 GHz-3.529 GHz.

Figure 7B:
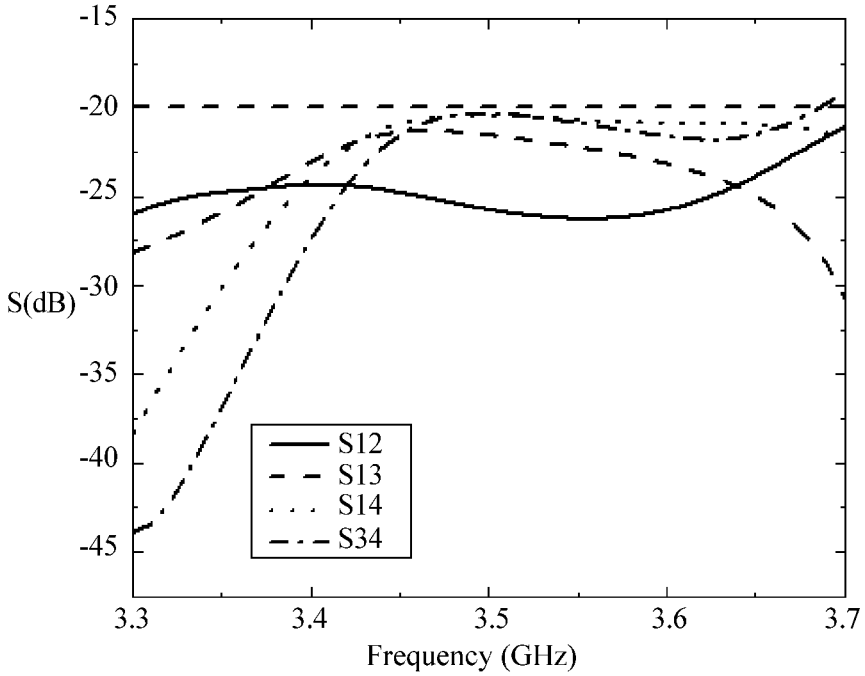

In FIGS. 7*b*, S12, S13, S14, and S34 are all less than −20 dB.

Figure 7C:
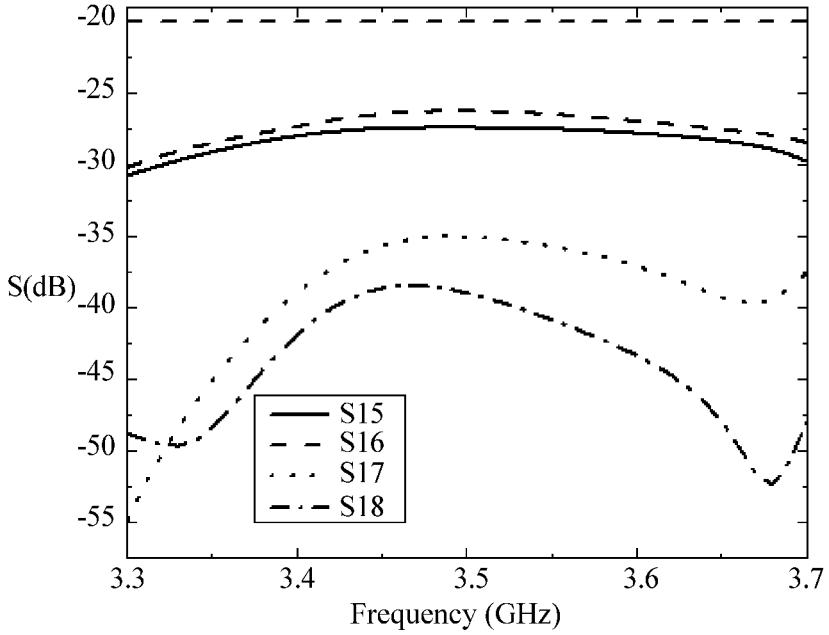

In FIGS. 7*c*, S15, S16, S17, and S18 are all less than −25 dB.

Figure 7D:
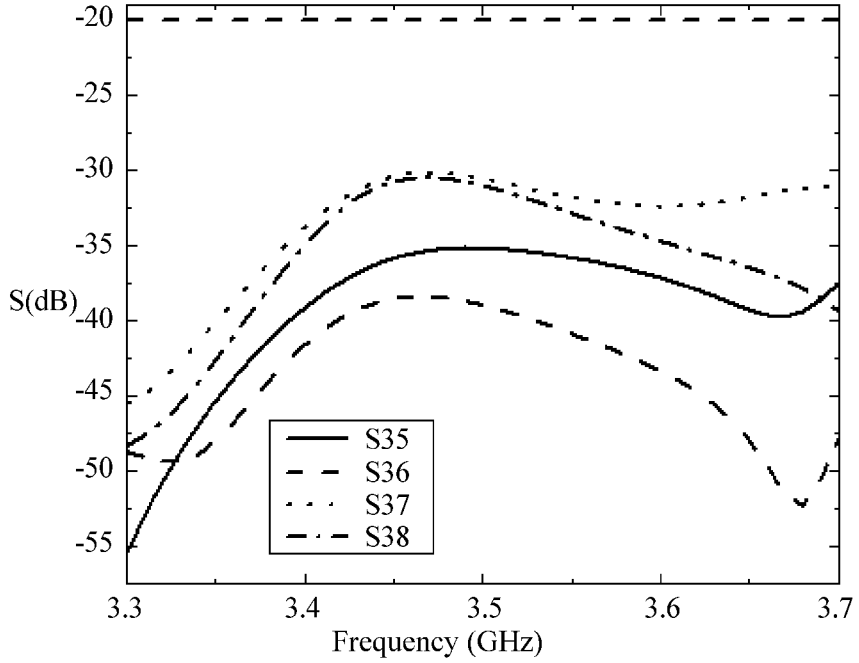

In FIGS. 7*d*, S35, S36, S37, and S38 are all less than −25 dB.

The multiple-antenna system shown in FIG. 2 operates in two frequency bands: 2.631 GHz-2.722 GHz and 3.440 GHz-3.529 GHz. A bandwidth at 2.7 GHz is 91 MHz, and an impedance bandwidth at 3.5 GHz is 89 MHz. It can be further seen from FIG. 6*b* to FIG. 6*d* and from FIG. 7*b* to FIG. 7*d* that isolation between the antennas in the multiple-antenna system shown in FIG. 2 is relatively high (less than −20 dB) in two frequency bands: 2.631 GHz-2.722 GHz and 3.440 GHz-3.529 GHz.

Simulation results of normalized radiation directions of the multiple-antenna system shown in FIG. 2 are shown in FIG. 8*a*, FIG. 8*b*, FIG. 9*a*, and FIG. 9*b*.

Figure 8A:
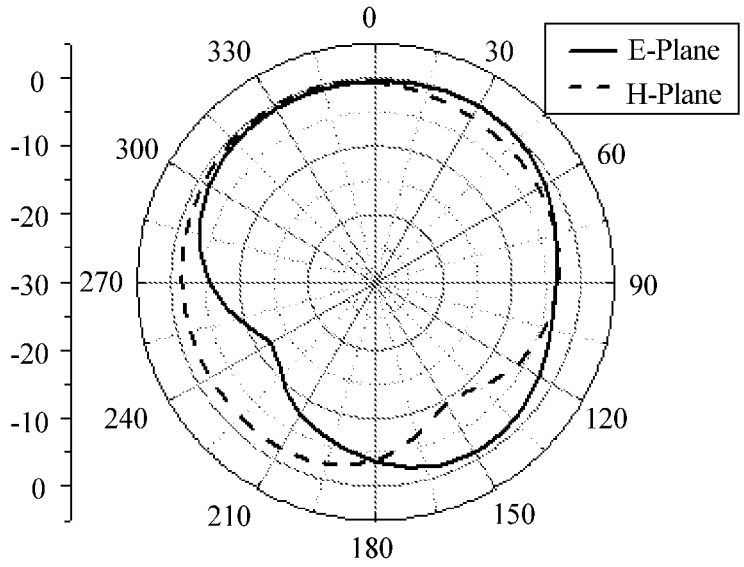
FIG. 8*a* is a diagram of a normalized radiation direction of a PIFA 10 of a first type that operates at 2.7 GHz.

FIG. 8*a* is a diagram of a normalized radiation direction of the PIFA 10 of the first type that operates at 2.7 GHz, showing radiation of the PIFA 10 of the first type.

Figure 8B:
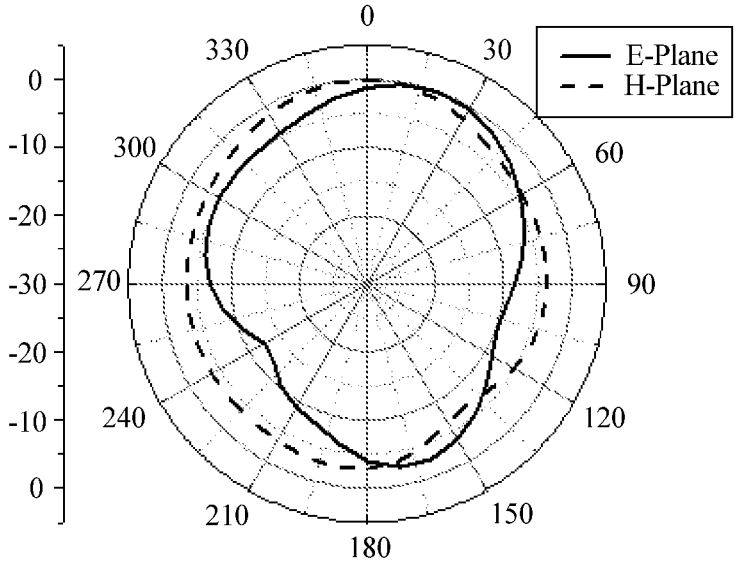
FIG. 8*b* is a diagram of a normalized radiation direction of a PIFA 10 of a first type that operates at 3.5 GHz.

FIG. 8*b* is a diagram of a normalized radiation direction of the PIFA 10 of the first type that operates at 3.5 GHz.

Figure 9A:
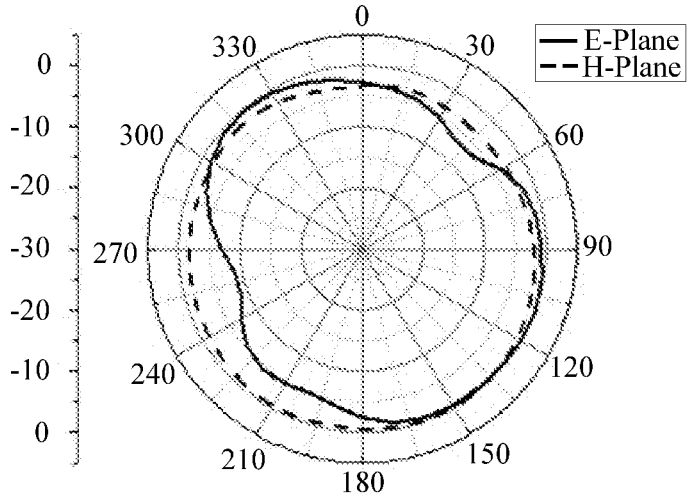
FIG. 9*a* is a diagram of a normalized radiation direction of a PIFA 80 of a second type that operates at 2.7 GHz.

FIG. 9*a* is a diagram of a normalized radiation direction of the PIFA 80 of the second type that operates at 2.7 GHz.

Figure 9B:
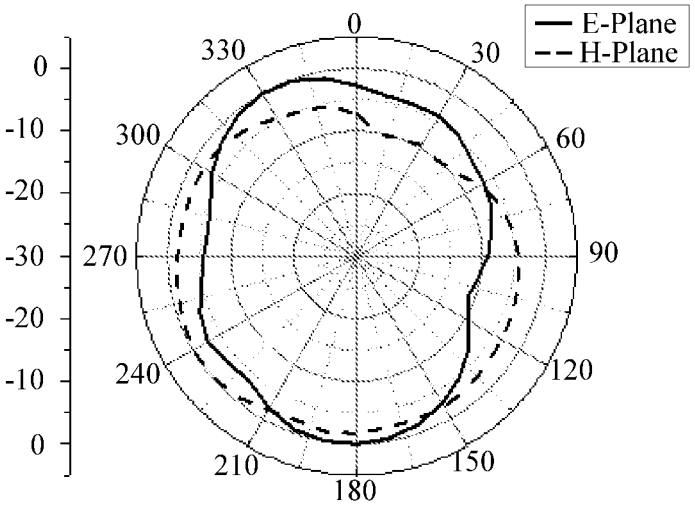
FIG. 9*b* is a diagram of a normalized radiation direction of a PIFA 80 of a second type that operates at 3.5 GHz.

FIG. 9*b* is a diagram of a normalized radiation direction of the PIFA 80 of the second type that operates at 3.5 GHz. It can be seen that the PIFA 10 of the first type and the PIFA 80 of the second type have a better isotropic radiation feature.

The multiple-antenna system shown in FIG. 2 is symmetrical with respect to both the xoz coordinate plane and the yoz coordinate plane. Therefore, simulation results of a parameter S and a diagram of a normalized radiation direction of another antenna are the same as the foregoing simulation results, and details are not described herein again.

Therefore, the multiple-antenna system shown in FIG. 2 is a multiple-antenna system that is of a small-sized mobile phone terminal and that can meet requirements for dual frequency bands, high isolation, and easy fabrication. For the multiple-antenna system shown in FIG. 2, an impedance matching value less than −10 dB in both a frequency band of 2.631 GHz-2.722 GHz and a frequency band of 3.440 GHz-3.529 GHz, and has relatively high isolation (less than −20 dB) respectively in the frequency band of 2.631 GHz-2.722 GHz and the frequency band of 3.440 GHz-3.529 GHz, requirements of a next-generation mobile communications system are satisfied.

Figure 10:
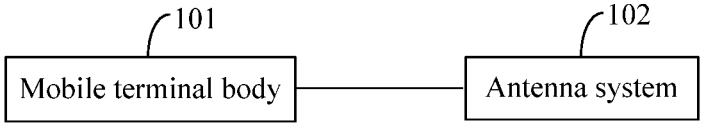
FIG. 10 is a schematic structural diagram of a mobile terminal according to another embodiment of the present invention.

FIG. 10 is a schematic structural diagram of a mobile terminal according to another embodiment of the present invention. The mobile terminal provided in this embodiment includes a mobile terminal body 101 and an antenna system 102, where the mobile terminal body 101 includes basic functional components, such as a processor and a memory, of a mobile terminal. The antenna system 102 may be any one of multiple-antenna systems provided in the foregoing embodiments, and is used to receive and transmit a signal for the mobile terminal body 101. The mobile terminal body 101 processes a signal received by the antenna system 102, generates a signal, and transmits the signal by using the antenna system 102.

The mobile terminal provided in this embodiment uses the foregoing multiple-antenna system, which can not only achieve a smaller volume, but also further improve communication performance of the mobile terminal because as many antennas as possible can be disposed in relatively small space.

Finally, it should be noted that the foregoing embodiments are merely intended for describing the technical solutions of the present invention, but not for limiting the present invention. Although the present invention is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the present invention.

What is claimed is:

1. A multiple-antenna system, comprising:

a planar inverted-F antenna (PIFA) of a first type comprising a first metallic ground plane, a first dielectric plate, a first radiation patch, a first probe-type feeding unit, and a first metallic shorting pin, wherein the first radiation patch is located on an upper surface of the first dielectric plate and is connected to the first metallic ground plane by using the first probe-type feeding unit and the first metallic shorting pin;

a PIFA of a second type perpendicular to the PIFA of the first type, the PIFA of the second type comprising a second metallic ground plane, a second radiation patch, a second feeding unit, and a second metallic shorted patch, wherein the second radiation patch is connected to the second metallic ground plane by using the second feeding unit and the second metallic shorted patch, wherein a straight-line-shaped slot is etched on the second radiation patch of the PIFA of the second type, and the second radiation patch is in a shape obtained by cutting off three corners from a rectangular; and an isolation stub located near the PIFA of the second type, the isolation stub located on an edge of a side of the upper surface of the first dielectric plate of the PIFA of the first type;

wherein the system includes four PIFAs of the first type and four PIFAs of the second type, wherein the four PIFAs of the first type are located at four corners of a quadrangle, two of the PIFAs of the second type are located outside a first side of the quadrangle, the other two PIFAs of the second type are located outside a second side of the quadrangle, the first side being opposite to the second side.

2. The system according to claim 1, wherein a distance from the PIFA of the first type to the PIFA of the second type is greater than or equal to 7 mm.

3. The system according to claim 1, wherein a U-shaped groove is etched on the first radiation patch of the PIFA of the first type.

4. The system according to claim 1, wherein an L-shaped slot is etched on the second radiation patch of the PIFA of the second type.

5. The system according to claim 1, wherein the second feeding unit of the PIFA of the second type comprises an L-shaped coaxial feeding unit.

6. The system according to claim 1, wherein the PIFA of the second type further comprises an L-shaped folded metallic ground plane that is disposed on an edge of the second metallic ground plane of the PIFA of the second type.

7. The system according to claim 1, wherein a distance from any one of the PIFAs of the first type to a nearest PIFA of the second type is greater than or equal to 7 mm.

8. The system according to claim 1, wherein a slot is etched on the second radiation patch of the PIFA of the second type, and the second radiation patch is in a shape obtained by cutting off three corners from a rectangular.

9. The system according to claim 1, wherein a dielectric constant of the first dielectric plate is between 1 and 10.

10. A mobile terminal, comprising:

a mobile terminal body; and a multiple-antenna system connected to the mobile terminal body and configured to receive and transmit a signal for the mobile terminal body, the multiple-antenna system comprising:

a planar inverted-F antenna (PIFA) of a first type, comprising a first metallic ground plane, a first dielectric plate, a first radiation patch, a first probe-type feeding unit, and a first metallic shorting pin, wherein the first radiation patch is located on an upper surface of the first dielectric plate and is connected to the first metallic ground plane by using the first probe-type feeding unit and the first metallic shorting pin;

a PIFA of a second type perpendicular to the PIFA of the first type, the PIFA of a second type comprising a second metallic ground plane, a second radiation patch, a second feeding unit, and a second metallic shorted patch, wherein the second radiation patch is connected to the second metallic ground plane by using the second feeding unit and the second metallic shorted patch, wherein a straight-line-shaped slot is etched on the second radiation patch of the PIFA of the second type, and the second radiation patch is in a shape obtained by cutting off three corners from a rectangular; and an isolation stub located near the PIFA of the second type, the isolation stub located on an edge of a side of the upper surface of the first dielectric plate of the PIFA of the first type;

wherein multiple-antenna system comprises four PIFAs of the first type and four PIFAs of the second type, wherein the four PIFAs of the first type are located at four corners of a quadrangle, two of the PIFAs of the second type are located outside a first side of the quadrangle, the other two PIFAs of the second type are located outside a second side of the quadrangle, the first side being opposite to the second side.

11. The mobile terminal according to claim 10, wherein a distance from the PIFA of the first type to the PIFA of the second type is greater than or equal to 7 mm.

12. The mobile terminal according to claim 10, wherein a U-shaped groove is etched on the first radiation patch of the PIFA of the first type.

13. The mobile terminal according to claim 10, wherein an L-shaped slot is etched on the second radiation patch of the PIFA of the second type.

14. The mobile terminal according to claim 10, wherein the second feeding unit of the PIFA of the second type is an L-shaped coaxial feeding unit.

15. The mobile terminal according to claim 10, wherein the PIFA of the second type further comprises an L-shaped folded metallic ground plane, that is disposed on an edge of the second metallic ground plane of the PIFA of the second type.

16. The mobile terminal according to claim 10, wherein a distance from any one of the PIFAs of the first type to a nearest PIFA of the second type is greater than or equal to 7 mm.

17. The mobile terminal according to claim 10, wherein a slot is etched on the second radiation patch of the PIFA of the second type, and the second radiation patch is in a shape obtained by cutting off three corners from a rectangular.

18. The mobile terminal according to claim 10, wherein a dielectric constant of the first dielectric plate is between 1 and 10.

* * * * *